United States Patent [19]

Norton

[11] 3,984,599

[45] Oct. 5, 1976

[54] LUBRICANT COATING COMPOSITIONS FOR USE IN METAL DRAWING OPERATIONS

[75] Inventor: James H. Norton, Corunna, Canada

[73] Assignee: Exxon Research and Engineering Company, Linden, N.J.

[22] Filed: Oct. 30, 1973

[21] Appl. No.: 411,073

[52] U.S. Cl. ..... 428/339; 252/33.4; 252/32.7 E; 252/46.6; 252/56 R; 252/59; 428/457; 428/467

[51] Int. Cl.[2] ..... C10M 1/48

[58] Field of Search .....252/32.7 E, 33.4, 46.6, 252/56 R, 59; 428/457, 467

[56] References Cited

UNITED STATES PATENTS

| | | | |
|---|---|---|---|
| 2,623,887 | 12/1952 | Matuszak | 252/56 R X |
| 2,882,228 | 4/1959 | Watson et al. | 252/56 R X |
| 3,080,330 | 3/1963 | Rudel et al. | 252/59 X |
| 3,108,968 | 10/1963 | Tice | 252/56 R X |
| 3,250,103 | 5/1966 | Beaubien et al. | 252/56 R X |
| 3,600,310 | 8/1971 | Eyres et al. | 252/56 R X |
| 3,642,635 | 2/1972 | MacLeod | 252/59 |
| 3,764,537 | 10/1973 | MacLeod | 252/56 R |
| 3,775,322 | 11/1973 | Hotten | 252/46.6 |
| 3,799,875 | 3/1974 | Rhode | 252/59 X |

FOREIGN PATENTS OR APPLICATIONS

| | | | |
|---|---|---|---|
| 1,062,863 | 8/1957 | Germany | 252/46.6 |

OTHER PUBLICATIONS

Smacheer et al., "Lubricant Additives", pp. 9–11, Lezius–Hiles Co., 1967.

*Primary Examiner*—Delbert E. Gantz
*Assistant Examiner*—Andrew H. Metz
*Attorney, Agent, or Firm*—Frank T. Johmann; Wayne Hoover

[57] ABSTRACT

A coating composition useful in metal working processes comprises a major amount of a mineral oil having a viscosity of 100°F of at least 100 SUS and (a) 1.0 to 20.0 parts by weight of a paraffin wax, (b) 0.1 to 10.0 parts by weight of a polymeric wax modifier and (c) 0.1 to 10.0 parts by weight of an extreme pressure agent. The compositions can also contain one or more rust inhibitors. Particularly preferred classes of extreme pressure agents for use in this comparison are sulfur containing agents and zinc salts of dialkyl dithiophosphates.

8 Claims, No Drawings

LUBRICANT COATING COMPOSITIONS FOR USE IN METAL DRAWING OPERATIONS

1. Field of the Invention

This invention relates to unctuous coating compositions which contain wax, a wax modifier and an extreme pressure agent for use in metal working processes. A particular feature of these coating compositions is that they can be applied to metal sheeting during a preliminary stage of the manufacture and remain in place on the sheeting during storage or transport and finally serve as a lubricant during metal forming of the sheeting.

2. Description of the Prior Art

In the recent past, the prior art has begun applying lubricant type coatings to metal sheets and coils at the steel mill to enable the consumer to carry out cold drawing and stamping operations without the use of additional lubricants. This procedure has overcome the disadvantages of prior techniques which required that messy and difficult to apply lubricants be applied by the consumer in plant before the cold drawing and stamping operations could be performed.

One lubricant type coating which has been applied at the steel mill is a lead phosphate which is deposited as a dry film lubricant on sheet steel from an acidic solution. Upon rinsing in an alkaline bath, a uniform layer of microcrystals of lead phosphate deposit on the surface of the steel. An emulsion of about 10% of a rust preventive in oil is then sprayed on the sheets for storage and shipment.

Another type of lubricant coating which has been applied at the steel mill is a polymeric film which is deposited on a steel sheet by air drying an ammoniacal colloidal dispersion of a modified acrylic type polymer onto the steel. A rust preventive type oil is then sprayed on the polymer coated steel either before storage and shipment or prior to drawing. The oil coating does not provide any essential lubrication and is used merely for its rust preventive properties. The polymeric film and oil overlay provide lubrication during the forming operation as a result of the polymeric film being plasticized by the oil from the heat generated by the forming operation.

The heat that is generated increases with the severity of the forming to provide greater plasticizing and lubrication for more deeply drawn parts. This process is described in greater detail in U.S. Pat. No. 3,568,486.

Although the technique of applying a lubricant film at the steel mill has many advantages over previous prior art processes, the lubricant films suffer from the disadvantage that they generally do not have good anti-wear and extreme pressure properties. It is important in metal forming operations to keep the lubricant in place under the effects of extreme pressure and wear. Further, the lubricant films generally require the application of two coatings, one being the primary film and the second being a coating of a rust preventive oil.

SUMMARY OF THE INVENTION

It has now been found that coating compositions useful in metal forming processes can be prepared by combining a major amount of a mineral oil having a viscosity of at least 100 SUS at 100°F with (a) 1.0 to 20.0 parts by weight of a paraffin wax, (b) 0.1 to 10.0 parts by weight of a wax crystal modifier and (c) 0.1 to 10.0 parts of an extreme pressure agent.

The compositions of the present invention can also include one or more anti-rust agents.

Preferably, the extreme pressure agent is a sulfur containing compound or a zinc dialkyl dithiophosphate. The sulfur containing compound can be a low molecular weight polysulfide or sulfurized and phosphosulfurized products derived from fatty acid esters of monohydric compounds, fatty acid esters of polyhydric compounds, olefins and polymeric olefins. The petroleum wax is preferably a paraffin wax substantially free of branched chain waxes that normally are found in microcrystalline wax and the wax crystal modifier is preferably selected from the group consisting of wax napthalene condensates, polyacrylates, and mixtures thereof. The anti-rust agent is preferably selected from the group consisting of a fatty acid partial ester of an aliphatic polyhydric alcohol; polyoxyethylene derivatives of these partial esters; metal sulfonates; and a mixture of a metal hydrocarbon sulfonate and aliphatic carboxylic acids of oxidized hydrocarbon wax, having an acid number of about 40 to 60, the proportion of sulfonate to wax acids being from about one-ninth to about one-fourth.

The lubricant compositions of this invention have a melting point of between about 100° to 150°F and are gels at room temperature. The compositions can be melted to a fluid condition where the wax is generally dissolved in the oil and coated onto metal sheets by spraying the melted fluid. The compositions are thixotropic and after application to the metal sheet return to their gel form to provide a thin, non-tacky, film on the metal surface during storage and handling of the metal sheet. The film thickness that is applied is between about 1.0 to 50 mils and preferably is about 5 to 20 mils. The gels are extremely stable with respect to bleeding during prolonged periods of storage or handling. It is believed that the stability of the gels results from the interaction of the wax crystal modifier with the wax as the wax precipitates from the cooling oil after the coating has been applied to form a finer, more stable crystal structure. These finer crystals in turn provide a superior gel by holding the oil in place and reducing its tendency to bleed or run.

The compositions of the present invention can be applied to sheet metal at the steel mill to provide a single, organic, oil based film, as the sole source of lubricant that is needed during subsequent metal forming operations. The presence of wax in the compositions of this invention allow coatings of greater thickness to be built up. Because of its gel-like structure at room temperature, a relatively heavy coating of rust preventive is obtained, and better rust protective results. Thus, the compositions of this invention can protect steel against corrosion from acidic atmospheres such as those encountered in steel mills due to the presence of pickling baths and the like.

The use of an extreme pressure agent in the compositions of this invention allows the metal to be formed more severely, that is, more deeply drawn than with prior art material. Other advantages provided by the extreme pressure agent used in the present invention include: less scoring of surfaces; less metal to metal contact, i.e., less welding and galling, smoother surfaces; uniform thickness to drawn parts; longer tool and die life, less wear, etc.; lower friction (and hence power consumed) during drawing operations; and permitting all forging operations to be used with one lubricant.

The coating compositions of the present invention can also be used with organic films, such as those described in the above-noted U.S. Pat. No. 3,568,486. The provision of an extreme pressure agent in the compositions of the present invention compensates for any holes or insufficiencies in the organic resin film used in the prior art which otherwise might permit scoring or tearing of the metal. Thus, the coating compositions of the present invention can produce good results in metal-forming processes in either the absence or the presence of an underlying primary lubricant film.

The compositions of the present invention can be applied to a variety of metals including plain carbon steel, stainless steel, alloy steels, superalloy steel, aluminum, and titanium. The compositions can be conveniently removed from the metal by a warm aqueous alkali wash when they are no longer needed.

This invention consists of the novel compositions, products, processes, and improvements shown and described. The foregoing general description and the following detailed description are exemplary and explanatory, but are not restrictive of the invention.

DETAILED DESCRIPTION OF THE INVENTION

The compositions of this invention contain a major proportion of a conventional lubricating oil, and most preferably a mineral oil.

The mineral oils useful in the composition of the invention will have a viscosity at 100°F of at least about 100 SUS and generally about 300 to 900 SUS. Preferably the oil has a viscosity at 100°F of 400 to 600 SUS and a pour point below about +30°F. These mineral oils may be fractions from low cold test crude oils which contain only small amounts of naturally occurring wax. The mineral oils may also be obtained from waxy crude oils by removing essentially all of the wax therefrom by a dewaxing step such as solvent (methyl-ethyl ketone, propane, etc.) dewaxing, plate and frame pressing and the like.

The mineral oils can vary widely in refinement, type and viscosity. They can be derived from a variety of crudes including paraffinic, naphthenic, asphaltic or mixed based and they can be treated by any of the conventional refining methods including hydrogen treating, acid treating extraction, etc. Naphthenic oils are presently preferred. Blends or mixtures of mineral oils can also be used.

The mineral oil base can have an SAE grade of from 5 to 60, and can have a boiling range of from 600 to as high as 1200°F. The mineral oil can be a highly refined oil which has been subjected to phenol extraction, solvent dewaxing and hydrofining. Such an oil is generally designated as either a low or medium cold test lubricating oil. One specific, particularly desirable, oil base is a blend of SAE 20 grade naphthenic oil derived by hydrofining a Tia Juana lube distillate with a SAE 40 grade naphthenic oil also derived by hydrofining a Tia Juana lube distillate. The blend is prepared by mixing 70 to 90 parts by weight of the SAE 20 grade oil with 30 to 10 parts by weight of the SAE 40 grade oil. The resulting blend has a viscosity of 450 SUS at 100°F and a viscosity index of about 50.

In accordance with the invention, the compositions contain a paraffin wax. The paraffin waxes used in the present invention preferably are free of branched chain waxes that normally are found in microcrystalline wax and have a 50 to 100% paraffinic content, preferably a 90 to 100% paraffinic content and can comprise paraffin waxes, deoiled refined waxes, and slack waxes.

Paraffin waxes that can be used in the compositions of the invention can consist of normal paraffins ranging from as low as $C_{20}H_{42}$ up to an average of about $C_{45}H_{92}$, with individual n-paraffins in the mixture ranging as high as 50 to 60 carbon atoms. Preferably the number average molecular weight of the wax should be in the range of about 350 to 450 and the boiling point of the wax is between about 120°F and 200°F. While it is possible to use individual paraffin hydrocarbons in practicing the invention, better results are usually obtained with a wax comprising a mixture of hydrocarbons. Furthermore, it is ordinarily not economic to employ individual normal paraffin hydrocarbons in the wax range.

The paraffin wax can be a slack wax derived from a distillate lubricating oil, and more particularly a light lubricating stock, having a boiling range of about 650°F to 1150°F A.E.T. (atmospheric equivalent temperature). The wax itself has a melting point range of about 100°F to about 170°F, and oil content of about 5 to about 50%, and a viscosity range at 210°F of about 35 to about 80 SUS. A preferred paraffin wax is one having a melting point range of about 130°F to about 165°F and a viscosity range at 210°F of about 55 to about 75 SUS, and is derived from a distillate oil having a boiling point range of about 800°F to about 1100°F.

Wax segregated from hydrocarbon oil is usually termed "slack wax", and contains from about 10% to 40% of oil. Slack wax is refined, usually by conventional sweating, to produce "crude scale wax" in a manner to reduce the oil content to less than about 5% by weight. The slack wax may be distilled to obtain the desired boiling range wax prior to sweating, if desired. This "crude scale wax" generally has an oil content of about 2% to 3% by weight. In order to remove this oil from the scale wax to produce a refined wax, such as refined paraffin wax having an oil content below about 0.5%, usually below about 0.3%, various procedures have been proposed and employed. One procedure may be to simply continue the sweating operation to lower the oil content of the crude scale wax.

Alternatively, the slack wax may be processed by a solvent deoiling process, to remove oil from the wax. In this method, the wax is dissolved in such solvents as methyl isobutyl ketone, methyl ethyl ketone, or mixtures of methyl ethyl ketone and toluene in a ratio of approximately 75 to 25, respectively. The wax solution is cooled to produce crystallization and the crystallized wax is removed by a process such as filtration. The filter cake of crystallized wax may be washed with cold solvent to remove occluded oil solution. The wax so produced may be an unfinished refined paraffin wax or an unfinished microcrystalline wax, depending on the nature of the slack wax feed and on the selection of crystallization conditions. After oil removal from the wax, it is subjected to a finishing process such as clay percolation or hydrofining. In the latter, the process involves treating the unfinished wax with hydrogen gas at a rate of about 0.5 – 1.0 volume per volume of wax per hour, at 300–800 p.s.i., at 500°–600°F, in contact with cobalt molybdate catalyst. Or, at lower pressures such as 200 p.s.i., a nickel catalyst may be used. The hydrogen-treated wax product is greatly improved with respect to color, odor and purity.

In accordance with the invention, the compositions of the present invention include wax crystal modifiers, otherwise known in the art as pour point depressants. Generally speaking, the invention is particularly useful when the composition contains 0.1 to 10.0 weight percent of an oil soluble lube oil pour depressant. These pour depressants commonly have number average molecular weights as measured for example by Vapor Pressure Osmometry, e.g., using a Mechrolab Vapor Pressure Osmometer Model 310A, etc., in the range of about 1000 to 200,000, and usually in the range of 100,000 to 200,000. These pour point depressants usually are characterized by straight chain alkyl groups having 8 to 20 carbon atoms attached as side chains to a hydrocarbon nucleus and generally at least 50 weight percent of the polymer will be in the form of the 8-20 straight chain alkyl groups. In one common type, the nucleus may be a polymethylene backbone or an aromatic or naphthalene group with the alkyl side chains directly attached to carbon atoms of said nucleus (e.g., copolymers of alkylated naphthalenes). In another type the alkyl groups will be linked to the nucleus through ether or ester linkages (e.g., copolymers of dialkyl fumarates and vinyl acetate).

Illustrative pour point depressants which may be present in the compositions of this invention include:

a. alkylated naphthalenes — i.e., naphthalenes which have been alkylated with e.g., chlorinated paraffinic waxes by use of Friedel-Crafts-type catalysts typified by those set forth in U.S. Pat. Nos. 1,815,022; 2,062,354; 2,087,682; and 2,174,246;

b. polymers, including copolymers, of alkyl unsaturated esters including: (1) polymers, including copolymers, of n-alkyl methacrylates typified by those set forth in U.S. Pat. No. 2,710,842; (2) polymers, including copolymers, of n-alkyl acrylates, such as, for example copolymers of ethylene and alkyl acrylates as described in U.S. Pat. No. 3,126,364 and Canadian Pat. No. 678,875; (3) copolymers of fumarates with vinyl acetate, such as, for example, copolymers of di-n-alkyl fumarate and vinyl acetate typified by those set forth in U.S. Pat. No. 3,048,479;

c. copolymers of ethylene with unsaturated ketones;

d. copolymers of ethylene and vinyl esters of lower fatty acids, such as, for example vinyl acetate, as described in U.S. Pat. Nos. 3,048,479; 3,093,623; and 3,131,168;

e. terpolymers of ethylene with vinyl esters and alkyl fumarates as described in U.S. Pat. Nos. 3,304,261 and 3,341,309; and the like.

As stated above, the alkylated naphthalene pour point depressants are usually prepared as the Friedel-Crafts condensation reaction product of a halogenated paraffin with an aromatic hydrocarbon. These materials are well known in the art, as lube oil pour depressants. Usually, the halogenated paraffin will contain from about 15 to 60, e.g., 25 to 35 carbons, and from about 5 to about 25, e.g., 10 to 18 weight percent chlorine. Typically, the halogenated paraffins used to prepare this well known class of wax modifiers are themselves prepared by chlorinating to the above-recited chlorine content a paraffin wax having a melting point within the range of about 100°to 200°F. The aromatic hydrocarbon used usually contains a maximum of three substituent groups and/or condensed rings and may be a hydroxy compound such as phenol, cresol, xylenol, or an amine such as aniline, but is preferably naphthalene, phenanthrene or anthracene.

A particularly preferred wax naphthalene is made from 100 parts by weight of a 128°F melting point n-paraffin wax which is chlorinated to 12 weight percent Cl and condensed with 14 parts by weight naphthalene using a Friedel-Crafts catalyst.

The polymers and copolymers of preferred oil soluble alkyl unsaturated esters used as pour point depressants in the composition of the present invention will generally have a number average molecular weight in the range of about 1000 to 200,000, preferably 100,000 to 200,000 as measured, for example, by the Vapor Phase Osmometry such as Mechrolab or Vapor Phase Osmometer. The ester monomers used to produce the polymers and copolymers include unsaturated mono- and diesters and can be represented by the general formula:

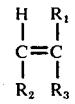

wherein $R_1$ is hydrogen or a $C_1$ to $C_4$ alkyl group, e.g., methyl, $R_2$ is a $—COOR_4$ or $—OOCR_4$ group wherein $R_4$ is a $C_6$ to $C_{20}$, preferably $C_{12}$ to $C_{18}$ straight chain alkyl group, and $R_3$ can be hydrogen, or $—COOR_4$. Such monomers, when $R_1$ is hydrogen and $R_2$ is $—OOCR_4$, include vinyl alcohol esters of monocarboxylic acids. Examples of such esters include vinylates such as vinyl laurate, vinyl myristate, vinyl palmitate and the like. When $R_2$ is $—COOR_4$ such esters include various acrylates such as lauryl acrylate, lauryl methacrylate, dodecyl acrylate, hexadecyl methacrylate, the $C_{13}$ Oxo alcohol ester of methacrylic acid, and the like. Examples of monomer where $R_1$ is hydrogen and $R_2$ and $R_3$ are both $—COOR_4$ include mono- and diesters of unsaturated dicarboxylic acids such as various fumarates, for example, mono—$C_{13}$ Oxo fumarate, di-$C_{13}$ Oxo fumarate, dilauryl fumarate, and the like.

The $C_8$ to $C_{20}$ alkyl ester monomers described above can be homopolymerized or can be copolymerized with various amounts, e.g., 0–70 mole percent, preferably 30 to 70 mole percent, based on the total polymer, of short chain esters having the above formula but wherein $R_4$ is a $C_1$ to $C_7$ alkyl group, such as methacrylates, acrylates, fumarates, maleates, vinylates, etc.

Specific examples of such short chain esters include, methyl methacrylate, methyl acrylate, isopropyl acrylate, isobutyl acrylate, vinyl acetate, vinyl propionate, vinyl butyrate, ethyl methyl fumarate, di-isopropyl maleate, and the like.

The Oxo alcohols mentioned above are isomeric mixtures of branched chain aliphatic primary alcohols prepared from olefins such as polymers and copolymers of $C_3$ to $C_4$ monoolefins, reacted with CO and hydrogen in the presence of a cobalt-containing catalyst such as cobalt carbonyl, at temperatures of about 300° to 400°F, under pressures of about 1,000 to 3,000 psi, to form aldehydes. The resulting aldehyde product is then hydrogenated to form the Oxo alcohol which is then recovered by distillation.

Polymers of the above type are well known in the art and are generally prepared by polymerizing the ester monomers described in the preceding paragraphs without diluting or in a solution of a hydrocarbon solvent such as heptane, benzene, cyclobenzene or white oil, at a temperature in the range of from 60°F, usually promoted with a peroxide type catalyst such as benzoyl peroxide, and usually under a blanket of an inert gas such as nitrogen or carbon dioxide in order to exclude oxygen.

The $C_8$ to $C_{20}$ alkyl ester monomers and the shorter chain $C_1$ to $C_7$ alkyl ester monomers can also be copolymerized with ethylene to form suitable pour point depressants and the copolymers formed thereby generally have an ethylene content of about 4 to 40, preferably 8 to 24, molar proportions of ethylene per molar proportion of ester monomer. These copolymers can be prepared using the techniques used for ethylene-vinyl ester copolymerizations, e.g., by copolymerizing a mixture of monomer and ethylene in the presence of a suitable catalyst such as a peroxy compound like ditertiary-peroxide at a temperature in the range of about 200° to about 300°F and a pressure in the range of about 700 to 5000 pounds. Similarly, the methods described in U.S. Pat. Nos. 3,048,479; 3,131,168; 3,093,623; and 3,254,063; etc., can also be used.

The copolymers of ethylene with an unsaturated ketone monomer which are useful for blending into the aforementioned waxes and oils generally have an ethylene content of about 3 to 40, preferably 3 to 20, molar proportions of ethylene per molar proportion of ketone monomer. Exemplary ketone monomers include vinyl methylketone, vinyl isobutyl ketone, vinyl n-octyl ketone, vinyl-isooctyl ketone, vinyl-dodecyl ketone, vinylphenyl ketone, vinyl-naphthyl ketone, vinylcyclohexyl ketone, 3-pentene-2-one, and the like. These copolymers can be prepared as set forth in commonly assigned application Ser. No. 744,667, filed July 15, 1968 and now U.S. Pat. No. 3,591,502.

In accordance with the invention, the compositions of this invention also include at least one extreme pressure agent. Sulfur containing extreme pressure agents are one class of preferred extreme pressure agents and include the following typical agents conventionally employed for this purpose: sulfurized and phosphosulfurized fatty acid ester oils of mono- and polyhydric compounds, such as sulfurized sperm oil, sulfurized lard oil, phosphosulfurized sperm oil, phosphosulfurized lard oil, sulfurized and phosphosulfurized tall oil; low molecular weight polysulfides such as dibenzyl disulfide or dilauryl trisulfide; sulfurized and phosphosulfurized olefins and polymeric olefins such as sulfurized cracked wax olefins, single olefins (e.g. octadecene-1), sulfurized terpenic olefins having 10 to 32 carbons including those further sulfurized by treatment with sodium sulfide, sulfurized poly-isobutylene, phosphosulfurized polyisobutylene, sulfurized isobutylene derivatives, and phosphosulfurized polyisobutylene treated with sulfur chloride. Numerous other conventionally employed extreme pressure additives may be utilized, alone or in combination, such as, for example, tricresyl phosphate, tributyl phosphite, chlorinated waxes, iodine compounds, borate and phosphate compounds.

Sulfurization of the above-noted oils, olefins and polyolefins is usually carried out by simply heating the olefin with free sulfur to about 180° to 250°C. The sulfur combines with the hydrocarbon portion of the molecule quite readily with an evolution of hydrogen sulfide. The reaction product may be blown to eliminate hydrogen sulfide, washed, and low boiling constituents may be evaporated or distilled off with steam. In many cases a small amount of free sulfur is present, not having reacted, and this may be separated by filtration. The sulfur may be either active or inactive as measured by tests for extreme pressure and corrosivity as its state is immaterial for the purpose of the present invention.

Another preferred class of extreme pressure agents that can be used in the present invention are metal salts of dialkyl dithiophosphoric acids. The metal salts of dialkyl dithiophosphoric acids are well known in the art. It is common practice to prepare dialkyl dithiophosphoric acids by reacting phosphorus pentasulfide with an aliphatic alcohol or a mixture of aliphatic alcohols containing the desired range of alkyl groups in a molar ratio of about 4 moles of alcohol for each mole of phosphorus pentasulfide. The acids are then neutralized with an oxide, hydroxide or carbonate of a polyvalent metal, or alternatively with a reactive polyvalent metal salt. The present invention employs polyvalent metal salts of dialkyl dithiophosphoric acids prepared from alcohols having in the range of from about 3 to about 12 carbon atoms. The dialkyl dithiophosphoric acids whose salts are used in this invention include not only those made from a simple aliphatic alcohol such as isopropyl, normal butyl, normal decyl, etc., but also from mixed aliphatic alcohols including the $C_5$ or $C_8$ alcohols obtained by reaction of olefins with carbon monoxide and hydrogen and subsequent hydrogenation of the resultant aldehydes. Also, there can be used dithiophosphoric acids obtained from such mixtures as isopropyl alcohol mixed with methyl isobutyl carbinol, a combination of primary amyl alcohol and isobutanol, a combination of mixed amyl alcohols and technical lauryl alcohol, a mixture of isopropyl alcohol and $C_8$ Oxo alcohol, and the like. Mixed acids obtained by reaction of individual alcohols separately with $P_2S_5$ can also be employed in the preparation of the metal salts. The metals employed in making the salts are those of Group II of the Periodic Table including zinc, barium, and magnesium. Zinc salts are particularly preferred.

A preferred extreme pressure agent used in the present invention is a zinc salt of a dialkyl dithiophosphate which was derived by reacting $P_2S_5$ with a mixture of 65 weight percent isobutyl alcohol and 35 weight percent primary amyl alcohol. The extreme pressure agents useful in the present invention generally impart antiwear properties to the compositions of the present invention.

The compositions of the invention preferably include a rust preventive agent such as the $C_{12}$ to $C_{22}$ fatty acid partial esters of aliphatic polyhydric alcohols having about 3 to 12, preferably 3 to 8, carbon atoms and about 2 to 8, e.g., 3 to 6 hydroxy groups per molecule. Preferred materials are the mono-, di-, and triesters of $C_3$ to $C_6$ alcohols having 3 to 6 hydroxyl groups and prepared from $C_{12}$ to $C_{18}$ fatty acids. The above type of partial esters include the partial alcohols as well as partial esters of non-dehydrated aliphatic polyhydric alcohols. Examples of these partial esters are: sorbitan monooleate, glyceryl monooleate, pentaerythritol monooleate, the di- and tri-oleates of sorbitan, mannitan, dulcitan, pentaerythritol and related polyhydric alcohols, the corresponding partial stearic and palmitic acid esters of these alcohols, and partial esters of these alcohols made from mixtures of these fatty acids. Agents of this type are well known in the art, and are described in numerous prior art patents, for example, U.S. Pat. Nos. 2,434,490 and 2,716,611.

The rust preventive agents can also comprise a polyoxyethylene derivative of the above partial esters and preferably a polyoxyethylene derivative of a partial ester of a hexitan and a fatty acid containing 12 to 20 carbon atoms per molecule. Sorbitan is the preferred hexitan as are fatty acids containing 18 carbon atoms per molecule. It is preferred to employ polyoxyethylene derivatives that contain a total of about 3 to 30 ethoxy groups per molecule. Specific examples of preferred polyoxyethylene derivatives are a polyoxyethylene derivative of soribtan monooleate containing a total of six ethoxy groups per molecule; polyoxyethylene derivatives of sorbitan monooleate (SPAN 80) (ATPET 80), sorbitan monostearate (SPAN 60 sold by Atlas Chemical Industries), sorbitan monopalmitate, and sorbitan monolaurate containing 3, 6, or 21 ethoxy groups per molecule; and polyoxyethylene derivatives of sorbitan trioleate and sorbitan triestearate containing 2 or 6 ethoxy groups per molecule.

The rust preventive agents, such as the partial esters and polyoxyethylene derivatives thereof disclosed herein, are employed in the compositions of this invention in proportions in the range of 0.5 to 20.0 percent, and preferably 1.0 to 5.0 percent by weight of the composition.

Metal sulfonates also can be used as rust preventive agents. The metal sulfonate rust preventive agents are the oil-soluble alkali metal and alkaline earth metal salts of high molecular weight sulfonic acids, generally produced by the treatment of petroleum oils of the lubricating oil range with fuming sulfuric acid. The sulfonic acids useful in preparing sulfonate additives generally have molecular weights of about 300 to 700, e.g., 350 to 500. Petroleum sulfonates have been described in numerous patents, e.g., U.S. Pat. No. 2,467,176 and are well known in the art. The sulfonates can also be derived from relatively pure alkyl aryl sulfonic acids having from about 10 to 33 carbon atoms per molecule. For example, sulfonated products of alkylated aromatics such as benzene, toluene, xylene, naphthalene, etc., alkylated with olefins or olefin polymers of the type of polypropylene, polyisobutylene, etc., can be used. Specific examples of sulfonates which are used as additives include petroleum sulfonates such as calcium di-$C_8$ alkyl benzene sulfonate, barium di-$C_9$ alkyl naphthalene sulfonate and sodium $C_{16}$ alkyl benzene sulfonate, wherein the $C_8$ alkyl group is derived from diisobutylene; the $C_9$ from tripropylene and the $C_{16}$ from tetraisobutylene.

The metallic sulfonates may be either neutral sulfonates, i.e., where the sulfonic acid is neutralized with an equal mole equivalent amount of metal base, or the sulfonates may be of the so-called "high alkalinity" type. In the latter case, additional metal base, in excess of that required for a simple neutralization, is reacted with the sulfonate to form an alkaline product which can then be blown with carbon dioxide to reduce its alkalinity and form a substantially neutral final product. Recent work has indicated that such so-called high alkalinity sulfonates are nothing more than dispersions of neutral sulfonates and a carbonate of the metal used which are believed to exist in the form of colloidal sols.

A still further rust preventive agent that can be used in the present invention is a rust preventive which is conventionally manufactured and marketed and is generally described as a mixture of a sodium petroleum sulfonate and oxidized hydrocarbon wax (paraffin), the oxidation having been carried to a sufficient extent so that carboxylic acids are produced. The sodium petroleum sulfonate component makes up between about 10 and about 25 weight percent while the balance is oxidized wax. The oxidized wax has an acid number of about 40–60 and the mixture contains the free carboxylic acid derived from the oxidized wax. The proportion of sulfonate to wax acids is from about one-ninth to about one-fourth.

The compositions of this invention can be prepared by methods known in the art. For example, the oil and wax can be premixed at a temperature in the range of about 160°F to about 200 F and then the crystal modifying additive can be added in solid or liquid form or all three components can be added simultaneously. The mixture is then agitated at the above temperatures for a period ranging from about 15 minutes to one hour and then cooled. The extreme pressure agent can be added at 140°F.

Generally the lubricating oil will form about 70 to about 95, preferably 80 to about 90 weight percent of the total composition; the paraffin wax from about 1 to about 20, preferably about 4 to about 10 weight percent of the total composition; and the crystal modifying additive will form about 0.1 to about 10.0, preferably 0.5 to 2.0 weight percent of the total composition.

The extreme pressure agent will form about 0.1 to about 10.0, preferably about 0.5 to about 3.0 weight percent of the total composition.

It is to be understood that while the compositions of this invention are usually produced by combining lubricating oils and wax, it would be possible to produce the same compositions by taking an equivalent lubricating oil which has not been dewaxed (but which normally contains only about 10 percent wax) and adding additional slack wax in order to bring the total weight percent of the wax in the final composition within the range contemplated by this invention, and that a composition formed in this manner is contemplated in the scope of this invention.

The following examples are given by way of illustration to further explain the principles of the invention. These examples are merely illustrative and are not to be understood as limiting the scope and underlying principles of the invention in any way. All percentages referred to herein are by weight unless otherwise specifically indicated.

EXAMPLE 1

The following composition is made by mixing the components listed in Table 1 below in the amounts indicated at a temperature of 140°–170°F.

TABLE 1

| | Parts by Weight |
|---|---|
| SAE 20 grade mineral lubricating oil | 73.5 |
| SAE 40 grade mineral lubricating oil | 15.0 |
| Wax | 5.0 |
| Rust Inhibitor A | 3.0 |
| Rust Inhibitor B | 2.0 |
| Zinc Dialkyl Dithiophosphate | 1.0 |
| Wax Crystal Modifier A and/or Wax Crystal Modifier B | 0.5 |

The wax is dissolved in the two mineral lubricating oils at 170°F. The blend is cooled to 140°F before adding the rust inhibitors (A&B) and the ZDDP. The wax crystal modifier A and/or B is added last at 140°F.

The SAE 20 and SAE 40 grade base oils are both naphthenic oils derived by hydrofining a Tia Juana lube distillate. The blend of the two base oils provides an optimum base oil viscosity.

The wax is a mixture of 20 weight percent oil and 80 weight percent oil of an essentially paraffinic wax having a melting point of 160°F and is derived from dewaxing of a 60 grade lube distillate originating from a Western Canadian crude.

Anti-rust Component A is a commercially availabe anti-corrosion agent sold under the name of Surpalox 319 and is generally described as a mixture of sodium soaps of petroleum sulfonates and oxidized hydrocarbon waxes, the oxidation being carried out to an extent that carboxylic acids are produced. The sodium petroleum sulfonate is present in the amount of about 10–25 weight percent acting as a solvent for the oxidized wax soaps while the balance is oxidized wax. Surpalox 319 has an acid number, according to ASTM D-974, of 40 to 46 and a saponification number, according to ASTM D-94, of 44 to 54.

Rust inhibitor B is a material sold commercially under the name Atpet 80 and is a sorbitan partial ester of tall oil. Atpet 80 is 100 percent active ingredient.

The zinc dialkyl dithio phosphate used in the composition contains 74 percent of the zinc salt and 26 weight percent of a mineral lubricating oil. The dialkyl dithiophosphate zinc salt was made by reacting $P_2S_5$ with a mixture of 65 weight percent isobutyl alcohol and 35 weight percent primary amyl alcohol. A typical specification for this type of zinc dithio phosphate salt is phosphorous content, weight percent 7.7–8.3, sulfur content, weight percent 15.8–17.2, and zinc content, weight percent 8.5–9.5

Wax Crystal Modifier A is a wax naphthalene made by condensing 100 parts by weight of a 128°F melting point end paraffin wax chlorinated to 12 weight percent chlorine with 14 parts by weight naphthalene by a Friedel-Crafts reaction.

Wax Crystal Modifier B is a polyacrylate of a molecular weight of 100,000–200,000. This polyacrylate was made from a $C_{10}$–$C_{18}$ alkyl ester of acrylic acid and is sold commercially under the name of Acryloid 710 by Rohm and Haas.

The composition of this example has the following typical inspections.

| | |
|---|---|
| Gravity °API | 22.2 |
| Specific Gravity 60/60°F | 0.921 |
| Consistency | Semifluid (thixotropic and resists drain off) |
| ASTM Pour °F | 90, approximately |
| Viscosity 100°F, SUS | 1059 |
| Viscosity 210°F, SUS | 57.3 |

The composition of this example is subjected to a series of three laboratory rust tests. These tests are carried out as follows:

1. Hydrobromic acid test (HBr test)

In this test, clean sandblasted steel panels are first dipped in a 0.1 percent hydrobromic acid aqueous solution and allowed to drain for one second, followed by dipping for 60 seconds into the oil composition to be tested. The panels are then stored in an upright position and are examined after 4 hours and evaluated. This test determines the effectiveness of inhibitors in a weak acidic environment as might be encountered in a crankcase oil during use and in general is regarded as a very severe test.

2. Humidity cabinet test

This test is carried out in accordance with the JAN-H-792 procedure and involves dipping clean steel sandblasted panels into the oil composition and suspending the composition in a humidity cabinet maintained at 100°F, and 100 percent relative humidity. The panels are periodically examined and the number of hours up to the first specks of rust is determined.

3. ASTM (distilled water) rust test

Briefly stated, this test is carried out according to ASTM D-655-54 procedure, and involves suspending a standard steel spindle (polished) in a mixture of 90 percent test oil and 10 percent distilled water. This mixture is stirred at 140°F for 24 hours and the spindle evaluated for degree of rusting. The degree of rusting is determined by visual inspection of the spindle specimen under normal light without magnification. For the purpose of this test, normal light is considered to be illumination of about 60 footcandles (65 lx). Within the meaning of this method, a rusted specimen is one on which any rust spot or streak is visible by the above inspection procedure. In order to report an oil as passing or failing, the test must be conducted in duplicate. An oil is reported as passing the test if both specimens are rust-free at the end of the test period. An oil is reported as failing the test if both specimens are rusted at the end of the test period. If one specimen is rusted while the other is free of rust, tests on two additional specimens are made. If either of these latter specimens shows rusting, the oil is reported as not passing the test. If neither of these latter specimens shows rusting, the oil is reported as passing the test. The ASTM rust test can also be performed by using acidic water or synthetic sea water in place of the distilled water.

The following Table II shows the results of the above tests when performed on the composition of this Example.

TABLE II

| | |
|---|---|
| ASTM Rust Test | |
| with distilled water | Pass, No rust |
| with acidic water, pH 5 | Pass, No rust |
| with synthetic sea water | Pass, No rust |
| ASTM Humidity Life, hrs. | 400+ |
| HBr Corrosion Test | Pass, No rust |

The composition of this example is also tested for its antiwear properties in the well known Falex (Faville-LeVally) Lubricant Tester. Details of this test and further references to it are described in Boner, "Gear and Transmission Lubricants", 1964, Reinhold Publishing CO., at pg. 224. When evaluated in the Falex Test, the composition exhibits a failure load to 4250 psi. The base oils of the composition when evaluated in the Falex Test would exhibit a failure load of approximately 100 to 300 psi.

EXAMPLE 2

The composition of Example 1 is evaluated in a commercial metal forming plant where automotive parts are fabricated. Metal (steel) sheeting used in this test is precoated with a polymeric film in accordance with the above-noted U.S. Pat. No. 3,568,486. For comparative purposes, a commercial metal drawing lubricant sold for use in conjunction with the above-noted polymeric film is also evaluated. Each oil is sprayed on the metal sheeting at a temperature of approximately 150°F to form a film of approximately 5–20 mils thickness. The sheeting is then allowed to stand under ambient conditions in storage for at least 24 hours or until needed for metal forming operations. The storage atmosphere is acidic because of pickling baths in the stamping plant.

The results of the metal drawing tests show the oil of this invention give; increased press die life because of its extreme pressure and lubricity properties; less scoring, galling and adhesion of the metal surfaces after drawing; better tolerances and more uniformity (less distortion) of the drawn parts; lower rate of rejects (off specification) for drawn parts; better surface finishes to drawn parts; and indication of higher production rate.

The invention in its broader aspects is not limited to the specific details shown and described and departures may be made from such details without departing from the principles of the invention and without sacrificing its chief advantages.

What is claimed is:

1. In a lubricant composition suitable for use in metal drawing operations which comprises a major amount of a mineral oil having a viscosity at 100°F. of at least 100 SUS and, based on the weight of the total composition, 1.0 to 20.0 weight percent of a petroleum paraffin wax having a melting point of 120° to 200°F. and 0.1 to 10.0 weight percent of an extreme pressure agent, the improvement wherein said composition also comprises from 0.1 to 10.0 weight percent, based on the weight of the total composition, of a wax crystal modifier selected from the group consisting of:

a. alkylated naphthalenes;

b. polymers and copolymers of oil soluble alkyl unsaturated esters characterized by the formula:

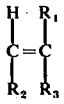

wherein $R_1$ is hydrogen or a $C_1$ to $C_4$ alkyl group, $R_2$ is a $—COOR_4$ or $—OOCR_4$ group wherein $R_4$ is a $C_6$ to $C_{20}$ straight chain alkyl group and $R_3$ can be hydrogen or $—COOR_4$, said polymers having a number average molecular weight in the range of about 1000 to 200,000; and c. copolymers of ethylene and unsaturated ketones.

2. The improvement of claim 1 wherein said lubricant has a melting point of 100° to 150°F and forms a non-tacky film when spread on a metal surface.

3. The improvement of claim 1 wherein said petroleum wax is a paraffin wax substantially free of branched chain waxes that normally are found in microcrystalline wax.

4. The improvement of claim 3 wherein said extreme pressure agent is selected from the group consisting of low molecular weight polysulfides, group 11 metal dialkyl dithiophosphates, and the sulfurized and phosphosulfurized products derived from fatty acid esters of monohydric compounds, fatty acid esters of polyhydric compounds, olefins and polymeric olefins.

5. The improvement of claim 1 wherein said wax crystal modifier is selected from the group consisting of:

a. addition polymers of aliphatic ethylenically unsaturated mono and diesters;

b. copolymers of said unsaturated esters and ethylene and c. wax naphthalene condensates.

6. A lubricating oil composition suitable for use in metal drawing operations containing a major amount of a mineral oil having a viscosity of more than 100 SUS at 100°F. and, based on the weight of the total composition, 1.0 to 20.0 weight percent of a wax having a melting point of 120° to 200°F., 0.5 to 20.0 weight percent of a rust inhibitor and 0.1 to 10.0 weight percent of an extreme pressure agent, the improvement wherein said composition also comprises 0.1 to 10.0 weight percent of a lube oil pour depressant selected from the group consisting of:

a. alkylated naphthalenes;

b. polymers and copolymers of oil soluble alkyl unsaturated esters characterized by the formula:

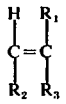

wherein $R_1$ is hydrogen or a $C_1$ to $C_4$ alkyl group, $R_2$ is a $—COOR_4$ or $—COOR_4$ group wherein $R_4$ is a $C_6$ to $C_{20}$ straight chain alkyl group and $R_3$ can be hydrogen or $—COOR_4$, said polymers having a number average molecular weight in the range of about 1000 to 200,000; and c. copolymers of ethylene and unsaturated ketones.

7. The improvement of claim 6 wherein said anti-rust agent is selected from the group consisting of (a) a fatty acid partial ester of an aliphatic polyhydric alcohol; (b) polyoxyethylene derivatives of these partial esters; (c) metal sulfonates; and (d) a mixture of a metal hydrocarbon sulfonate and aliphatic carboxylic acids of oxidized hydrocarbon wax, having an acid number of about 40 to 60, the proportion of sulfonate to wax acids being from about one-ninth to about one-fourth.

8. A metal sheeting suitable for use in stamping operations which is coated with a film of the composition of claim 1 wherein said film has a thickness of 1.0 to 50 mils.

* * * * *